US005188348A

United States Patent [19]

Fuseki

[11] Patent Number: 5,188,348

[45] Date of Patent: Feb. 23, 1993

[54] SIGNATURE INSPECTION DEVICE FOR FOLDER OF WEB PRINTING PRESS

[76] Inventor: Takashi Fuseki, c/o Komori Corporation Toride Plant 5-1, Higashi 4-chome, Toride-shi, Ibaragi-ken, Japan

[21] Appl. No.: 769,542

[22] Filed: Oct. 1, 1991

[30] Foreign Application Priority Data

Oct. 8, 1990 [JP] Japan ..... 2-105246[U]

[51] Int. Cl.[5] ..... B42C 1/00; B31B 1/00

[52] U.S. Cl. ..... 270/45; 270/32; 493/12

[58] Field of Search ..... 270/1.1, 45, 36, 56; 493/12, 27, 3, 8

[56] References Cited

U.S. PATENT DOCUMENTS 3,815,895 6/1974 Dufour ..... 270/56
3,822,877 7/1974 Littleton ..... 270/56
3,948,510 4/1976 Iwamoto ..... 493/27
4,936,562 6/1990 Rowe ..... 270/56
5,026,035 6/1991 Martinez Sanz ..... 270/56
5,049,227 9/1991 Long ..... 493/8
5,125,635 6/1992 Iwabuchi ..... 270/56

FOREIGN PATENT DOCUMENTS 3417420 12/1984 Fed. Rep. of Germany ..... 493/3

*Primary Examiner*—Edward K. Look
*Assistant Examiner*—John Ryznic

[57] ABSTRACT

A phase difference is determined between a signature detection sensor signal and a reference timing signal from a rotary encoder and displayed as a deviation amount to determine a tendency of the deviation, and the printing press can be adjusted according to the tendency to prevent paper jamming.

2 Claims, 2 Drawing Sheets

SIGNATURE INSPECTION DEVICE FOR FOLDER OF WEB PRINTING PRESS

FIELD OF THE INVENTION

This invention relates to a signature inspection device for use in a folder of a web printing press, which checks flow of signatures and folding precision to prevent paper jamming of the folder.

BACKGROUND OF THE INVENTION

In a web printing press which is a machine to print on a rolled paper, a folder, which folds printed paper fed from the main unit of the printing press (hereinafter referred to as "printing machine"), is provided with a safety device which detects paper jamming and stops operating the printing machine.

In this case, detection of paper jamming is achieved by using a limit switch or a photoelectric sensor, which is located at a position where the signature tends to cause jamming, for example, in the course of the signature flowing path, to detect staying of the signature for a time exceeding a predetermined period.

However, in such paper jamming detection by a limit switch or photoelectric sensor, there has been a problem in that, due to a high printing speed, a large amount of paper tends to build up during the time from the beginning of paper jamming to the detection of the jamming and stoppage of the printing machine by the function of the safety device, which leads to damages to the components and requires a long time for the printing machine to resume normal operation.

Then, as an alternative method to minimize paper jamming, a deviation amount is detected between an actual signature detection timing from a sensor and a timing of signature position, where the signature is to be positioned, according to the rotation phase of the folder roller to find a condition at the beginning of paper jamming.

However, in the detection of the beginning of paper jamming, the safety device tends to operate before the beginning of paper jamming to stop the machine due to a high printing speed and depending on the deviation in relative positions or on the detection accuracy. In addition, since a web printing press requires a long time from the starting to normal operation, it is often required to avoid stopping the printing machine as possible, and the detection accuracy must be adjusted not too sensitive and not too insensitive to obtain an optimum detection accuracy. However, in practice, it is difficult to satisfy both conditions.

DISCLOSURE OF THE INVENTION

In accordance with the present invention, there is provided a signature inspection device for a folder of a web printing press, comprising a sensor for detecting signatures flowing in the folder, a timing signal generator for the folder, a comparator for comparing signals from the sensor and the timing signal generator to obtain a phase difference between the signature and the folder, and an indicator for displaying a deviation based on the phase difference for each of signatures.

The sensor signal is compared with the timing signal to display the deviation amount of each signature according to the phase difference between the signals, that is, displaying a folding defect level quantitatively. This clarifies the tendency to paper jamming, and the folder can be adjusted according to the information including the tendency to prevent paper jamming, and to stop operation of the printing machine as needed at a proper timing.

DESCRIPTION OF THE PREFERRED EMBODIMENTS

Figure 1:
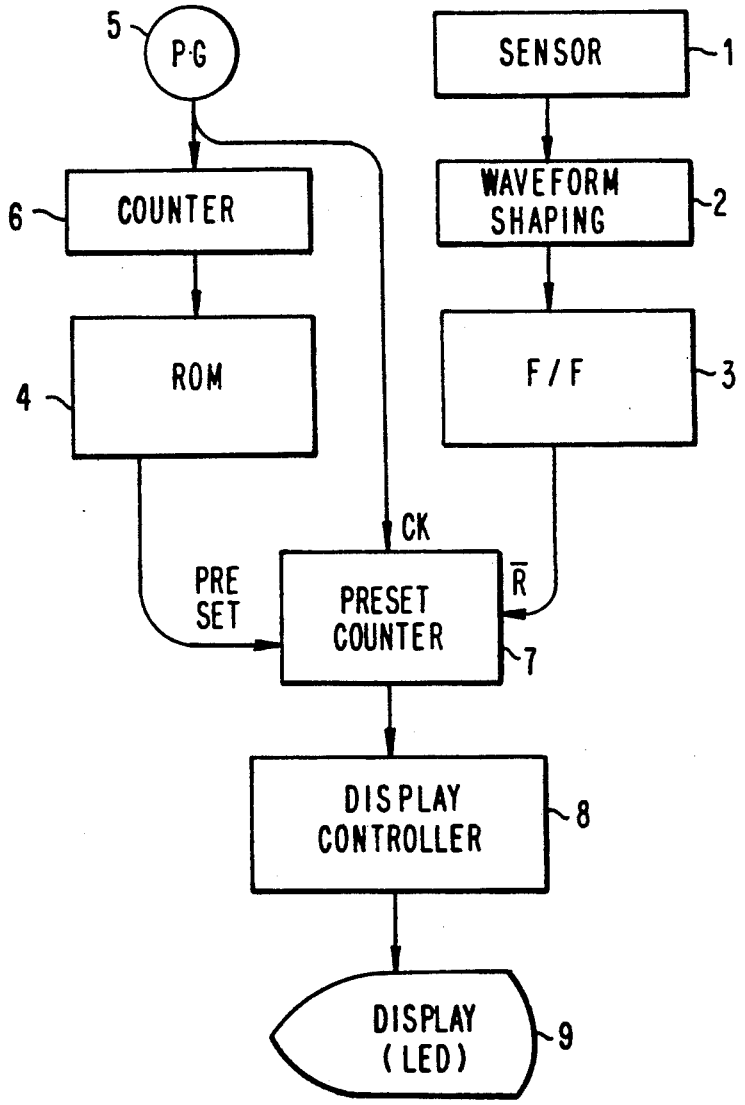
FIG. 1 is a block diagram of an embodiment according to the present invention.

An embodiment of the present invention will now be described with reference to FIGS. 1 to 3. FIG. 1 is a block diagram showing an embodiment of the signature inspection device according to the present invention. Referring to FIG. 1, a sensor 1 is disposed on a signature flow path of a folder, which provides a signal indicating the presence of paper. Length of the signal is determined by the specific folder and its folding specifications.

After the sensor 1, there is provided a flip-flop circuit 2, through a waveform shaping circuit 2, to prevent misoperation. The flop-flop circuit 3 turns on at a rising edge of the sensor 1 signal and turns off at a falling edge of the sensor 1 signal to output a signature timing signal.

In addition, a ROM 4 is provided which stores a folder timing signal to output a timing signal as a reference of the signature. The timing signal differs among individual folders, thereby obtaing a reference signal according to the specific folder. Length of the signature is known according to the folder type. The range of paper existence is previously known as the number of rotary encoder pulses from the feeding of the first signature, and the data is previously written in the ROM.

Output of the ROM 4 is obtained with reference to an output of a rotary encoder 5, which is a rotation detector mounted to a rotary shaft rotating in line with a plate cylinder, and to an output of a counter 6, which counts and frequency divides the output of the rotary encoder 5. Thus, the ROM 4 is read from the count output of the rotary encoder 5.

The timing signal of the sensor 1 as the output of the flip-flop circuit 3 and the reference timing signal from the ROM 4 are compared by a counter 7. In the counter 7, a phase difference between these timing signals is obtained by a pulse signal from the rotary encoder 5. The phase difference as a deviation amount is fed through a controller 8 and displayed on an indicator 9.

Figure 2:
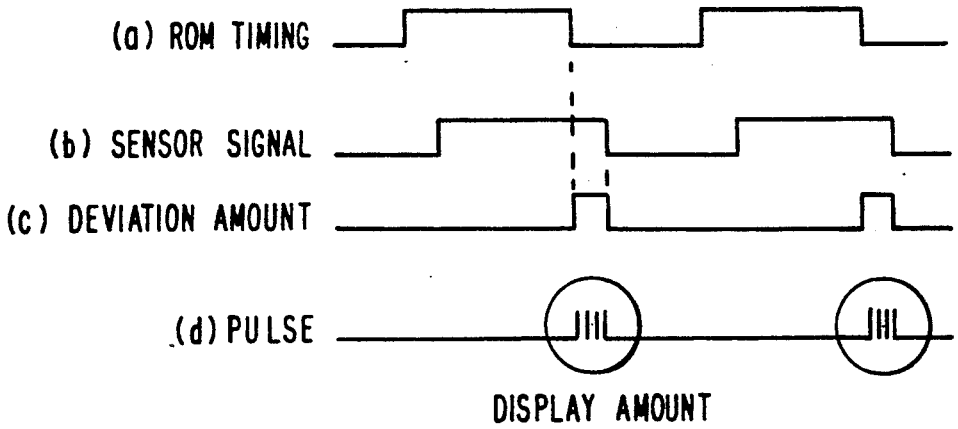
FIG. 2 is a waveform of the block shown in FIG. 1.
Figure 3:
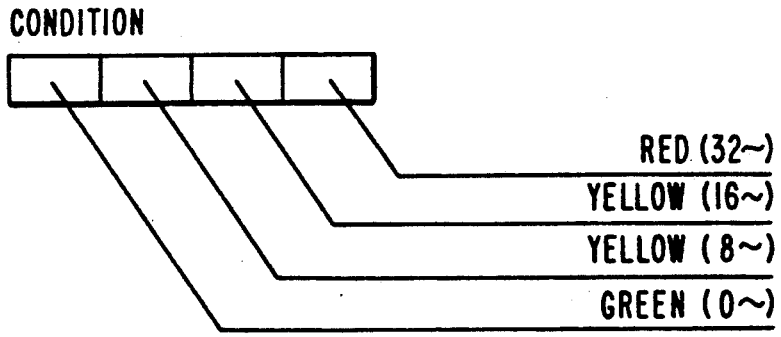
FIG. 3 is a schematic view of indication on an indicator.

FIG. 2 is a waveform diagram. The counter 7 receives a retard/advance signal (deviation amount (c)) of the signature relative to the folder which is a phase difference between a ROM 4 timing signal (a) and a sensor output (b) by the flip-flop circuit 3, to form a pulse signal of the deviation amount as a display amount.

Thus, the indicator 9 displays whether or not each signature comes within a correct timing and, when there is a deviation, how much is the deviation, in four steps. FIG. 3 is a schematic view showing an indication on the indicator 9, showing deviation amounts in colors. The indication always moves when signatures are flowing since each color is displayed after a paper exist indication, and the indication is maintained when a paper jamming occurs. When a deviation occurs exceeding a predetermined value, there is a danger of paper jamming and a signal is generated to stop the printing machine.

Since, in this embodiment, the deviation amount is detected and displayed for each signature, and tendency of signature flow and insufficient accuracy can be obtained, it is possible to make adjustment of the printing machine such as lap amount adjustment without interrupting the operation of the printing machine.

Furthermore, when the deviation amount becomes increased, the printing machine can be quickly stopped to minimize the number of jammed paper, it is possible to adjust the cutting pressure, which is the cutting blade protrusion adjustment, and the register lay, which is the timing and protrusion adjustment of the plate cylinder register lay.

In this embodiment the sensor detects the presence and absence of paper on the signature flow path. However, alternatively, it is also possible to change the sensor position so that a signature wound around (pressed by the brush) the cylinder can be detected to determine the cutting length and adjust the paper tension or the like without viewing signatures during operation.

This embodiment uses LEDs for bar indication. Seven-segment displays can alternatively be used to achieve numerical indication.

The deviation amount can be automatically adjusted by inputting a signal, converted to an adjustment value, to an actuator mounted to each adjustment position.

As described above, with the present invention, the signature deviation tendency can be obtained to prevent paper jamming and stop operation of the printing machine when a large deviation occurs, thereby reducing occurrence of waste paper, enabling adjustment before occurrence of paper jamming and rapidly resuming normal operation.

I claim:

1. A signature inspection device comprising a sensor for detecting signatures flowing in a folder, a timing signal generator for the folder, a comparator for comparing signals from said sensor and said timing signal generator to obtain a phase difference between the signature and the folder, and an indicator for displaying a deviation based on the phase difference in a plurality of grades according to its magnitude.

2. The device of claim 1 wherein the folder is adjusted according to a tendency over time of the deviation.

* * * * *